United States Patent [19]

Paul

[11] Patent Number: 4,483,029

[45] Date of Patent: Nov. 20, 1984

[54] FLUIDIZED SUPPORTING APPARATUS

[75] Inventor: Patrick R. D. Paul, Charleston, S.C.

[73] Assignee: Support Systems International, Inc.

[21] Appl. No.: 400,381

[22] Filed: Jul. 21, 1982

Related U.S. Application Data

[63] Continuation-in-part of Ser. No. 291,486, Aug. 10, 1981, abandoned.

[51] Int. Cl.[3] ..... A61G 7/00; A47C 27/08

[52] U.S. Cl. ..... 5/453; 5/423; 5/469; 128/33

[58] Field of Search ..... 5/449, 453, 454, 469, 5/423, 431, 464, 451; 128/38

[56] References Cited

U.S. PATENT DOCUMENTS

| | | | |
|---|---|---|---|
| 3,428,973 | 8/1970 | Hargest et al. | 5/449 |
| 3,670,347 | 6/1972 | Weinstein | 5/451 |
| 3,760,800 | 9/1973 | Staffin et al. | 128/38 |
| 3,866,606 | 2/1975 | Hargest | 5/453 |

*Primary Examiner*—Alexander Grosz

*Attorney, Agent, or Firm*—Wellington M. Manning, Jr.; Luke J. Wilburn, Jr.

[57] ABSTRACT

A fluidized patient support structure in which a mass of granular material is received within an open top container between a fluid diffuser plate and a flexible sheet on which the patient may lie in a supine position. Pressurized fluid passes through the diffuser plate and suspends the granular material in a fluidized form. The diffuser plate has a predetermined variable contour and a predetermined depth of fluidized material thereabove adequate to support a patient in a supine position.

18 Claims, 6 Drawing Figures

FLUIDIZED SUPPORTING APPARATUS

CROSS REFERENCE TO RELATED APPLICATION

This application is a continuation-in-part of application Ser. No. 291,486, filed Aug. 10, 1981, and entitled "Improved Fluidized Supporting Apparatus" now abandoned.

BACKGROUND OF THE INVENTION

This invention relates to an improved fluidized patient support system that is of particular advantage to burn patients, as well as other patients who are immobilized for extended recuperative periods.

Historically, hospital beds for patients have in general been conventional where, though adjustable as to height and attitude, a mattress-springs arrangement has been provided for receiving the patient thereon covered, of course, with appropriate bed clothing. Particular problems have developed in use of the conventional hospital beds where the patients, due to prolonged contact with the support surface in generally immobile conditions, have developed decubitus ulcers or bed sores, as a result of pressure points between the support surface and certain portions of the patient's body. Additionally, in the case of burn patients where the severity of the injury or wound was such that the patient was affected over a significant portion of his body, the conventional bed presented problems not only with the healing process due to contact between raw areas of the human body and the support, but also due to fluids exuding from the patient's body. In like fashion, other types of injuries and reasons for confinement have presented problems with the conventional hospital bed.

In order to obviate some of the problems inherent with the conventional hospital bed, fluidized patient support structures have been developed as exemplified in the Hargest U.S. Pat. No. 3,428,973, in which a tank is provided, partially filled with a mass of granular material which is received atop a diffuser surface and is covered with a loose fitting flexible patient contact sheet or surface. Fluid, such as air, is forced through the diffuser and fluidizes the granular material, preferably ceramic spheres, with adequate force that a patient received on the flexible sheet is suspended on the fluidized bed. In this fashion, very gentle forces are imparted to the body portions of the patient, whereby the incidence of development of decubitus ulcers is reduced and whereby an individual experiencing trauma, such as produced by severe burns may rest comfortably. In similar fashion, a further fluidized patient support structure is disclosed in the Hargest U.S. Pat. No. 3,866,606 which structure has the same basic elements of that mentioned above with the addition of control means to cyclically fluidize the granular material, also preferably ceramic spheres, for floatation of the patient, whereby in a non-fluidized state, the patient settles into the mass of granular materials which becomes a rigid body contoured structure against which the patient's body may be placed in traction. In like fashion, the cyclic effect of fluidizing-rigidifying the mass of granular material permits variation in patient attitude, again towards the reduction of the incidence of development of decubitus ulcers.

In both of the fluidized patient support systems described above, there is in use of ceramic spheres, for an adult patient, generally a minimum depth of about 12 inches of fluidized granular material located above the diffuser board to preclude any contact between the body of the patient and the diffuser board when the patient is in a sitting position on the bed. In particular, when a patient is attempting to get out of the support structure, and does so by assuming a sitting position, there is of course a greater amount of weight in a concentrated area, such that with less than the 12 inch minimum of granular material or thereabouts, the buttocks of the patient could sink through the material, leaving only a cover sheet above the diffuser board, thereby creating a high pressure point. For support systems for children, or an adult patient which will remain in a supine position, a lesser minimum depth of granular materials is required. Additionally, in a commercial embodiment of the fluidized adult support surface, a quantity of approximately 1,600 pounds of ceramic spheres is employed, thus necessitating significant size and strength for the supporting framework of the fluidized structure to achieve the intended purposes. A total bed weight of approximately 2,200 pounds results, with the side walls of the structure extending above the diffuser board being dictated by the minimum depth requirements. In like fashion, due to the great weight of the overall structure, the supporting framework of course must be suitable for maintaining same. These and other requirements of the present commercial structures thus limit the use of the same due to expense, structural design limitations, size, and the like. Still further, with the commercially available structures, though same are particularly efficacious, use is restricted, especially outside of specialized hospital treatment areas.

Further with respect to the fluidized patient support structure mentioned above, the diffuser board in commercial use is a particle board having a generally uniform porosity thereacross where the porosities are sized at approximately 5 microns to permit the passage of fluid therethrough while at the same time precluding the passage of the ceramic microspheres or other granular material.

The improved structure of the prersent invention will perform at efficacy levels equal to that of the presently commercial fluidized patient support systems, while at the same time, avoiding the problems or structural requirements for same as outlined above. As such, the fluidized patient support structure of the present invention represents a smaller, less costly, lighter, and more versatile patient support structure, the maintenance requirements for which are significantly less stringent.

SUMMARY OF THE INVENTION

It is an object of the present invention to provide an improved fluidized patient support system.

Yet another object of the present invention is to provide a fluidized patient support system that is flexible in design characteristics, is light, relatively inexpensive, and easy to maintain free of contamination.

Still further, another object of the present invention is to provide an improved fluidized patient support system, the fluidized mass portion for which is contoured according to dictates of the patient residing thereon.

Still another object of the present invention is to provide an improved fluidized patient support system that utilizes a varying depth mass of fluidizable granular material.

Generally speaking, the improved patient support structure according to teachings of the present invention comprises an open top container means; a mass of granular material received within said container; means for supporting non-fluidized granular material at predetermined varying depths with said container, said support means being porous to fluid passage and impervious to passage of granular materials; means for fluidizing said granular material above said material support means, said fluidizing means and porosity of said material support means being correlated such that said granular material across said container is fluidized above said material support means adequate to support all body areas of a patient in a supine position; and flexible means enclosing said granular material for receipt of a patient thereon, said flexible means permitting passage of a fluid through at least a portion of same while precluding passage of granular material therethrough.

In one preferred embodiment, the improved patient support system according to teachings of the present invention comprises an open top container means; a mass of granular material received within said container; means for supporting a first portion of said granular material at a first depth within said container, and at least one further portion of said material at a lesser depth within said container, outwardly from and contiguous to said first portion of granular material, said support means being variably porous to fluid passage and impervious to passage of granular material; means for fluidizing said granular material above said support means, the porosity of said support means beneath each portion of granular material being a predetermined value, correlated to the depth of granular material thereat and pressure of the fluidizing means such that all body areas of a patient in a supine position are supportable by said fluidized granular material; and flexible means enclosing said open top of said container, said enclosing means permitting passageway of fluid through at least a portion of same while precluding passage of granular materials therethrough. In a further preferred embodiment of the present invention, the material support means may have a uniform porosity and parameters of the fluidizing means may be varied across said support means according to the depth of granular material thereabove to achieve a proper fluidized bed of granular material.

More specifically, the fluidized patient support system of the present invention comprises a tank having an open top into which a support member is placed, being located above a bottom wall of the tank to define one or more plenum chambers therebetween. Located atop the support member is a contoured diffuser element. A mass of granular materials, preferably ceramic spheres, is placed atop the diffuser plate with a flexible sheet draped across the top of the mass of granular material. A means is provided for introduction of a pressurized fluid into the plenum chamber, whereupon the fluid passes through the diffuser plate and depending upon the pressure of same, flow of same and porosity of the diffuser plate, fluidizes the granular material thereabove. Obviously it is necessary that the parameters of fluid flow, fluid pressure and diffuser plate porosity, coupled with the mass of granular material be such that the granular material is in a fluidized state and that a patient may be adequately supported thereby. According to the present invention, the diffuser plate generally follows a contour dictated by normal patient placement thereabove. The diffuser plate is located at a greater elevation within the tank in those areas where less pressure requirements are necessary for patient support. In achieving these goals, a porous polymeric element is suitable. The degree of porosity of the diffuser element may increase proportionately with the depth of granular material to be received thereover or alternatively porosity may be constant and the fluidizing force varied by controlled fluid passage through baffles, by a plurality of fluidizing means, or the like.

The improved fluidized patient support structure according to the present invention significantly reduces the amount of granular material required for fluidized patient support while at the same time, preferably provides adequate fluidized depth in a medial portion of the structure, such that one in a sitting position will not make contact through the flexible sheet with the diffuser element therebeneath. Generally 30 percent weight reduction in granular materials is possible compared to existing commercial structures. Initial cost of the frame of the fluidized patient support structure is thus lessened. Likewise, the cost of the ceramic spheres or other granular material is significantly reduced, both from initial loading and replacement loads as well. The reduction in weight and design rigidity permits greater mobility of the fluidized bed, such that the structure according to teachings of the present invention may be portable, permitting patient transfer directly from an operating room table to the fluidized bed, for example, and eliminating use of a stretcher.

In like fashion, the psychological disposition of the patient is greatly improved since greater design variation is permissible with the structure according to the present invention leading to the availability of significantly improved aesthetic designs.

DESCRIPTION OF THE PREFERRED EMBODIMENTS

Figure 1:
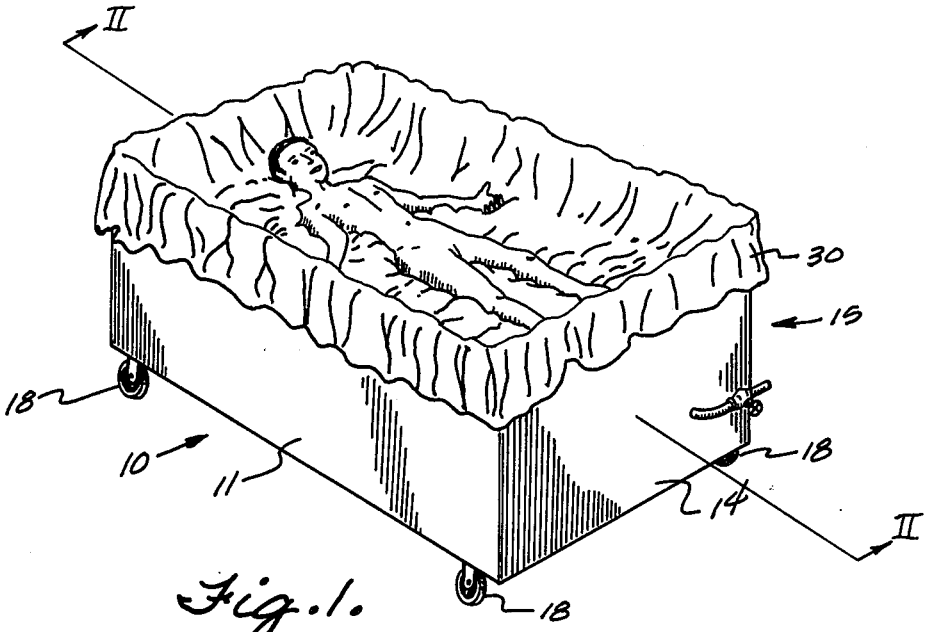
FIG. 1 is a perspective view of an improved patient support structure according to teachings of the present invention.

Making reference to the Figures, preferred embodiments of the present invention will now be described in detail. In FIG. 1, a patient support structure according to teachings of the present invention, is shown assembled in an isometric view wherein the structure generally indicated as 10 is provided with vertical side walls 11 and vertical end walls 14 which combine with the bottom wall 16 (not shown) to define an open top tank or container, which has a flexible sheet material 30 received within same and supported by a fluidized bed of granular material (not shown) and on which a patient directly resides. As illustrated in FIG. 1, the patient will generally settle to a certain depth within the fluidized bed of granular material with the flexible sheet 30 conforming to the body due to the fact that in those immediately adjacent areas where body contact is not made, the fluidized bed extends to a higher elevation than beneath the body of the patient. As mentioned hereinbefore, the fluidized patient support device 10 of the present invention, due to its unique construction, has a total weight significantly less than prior art fluidized structures. Though prior art structures have included wheel support, the devices have not been truly mobile, and in fact, certain of the prior devices have utilized spring arrangements in conjunction with wheels which were compressed when granular materials were placed into the container and rendered the wheels inoperative. Structures according to the present invention may be manufactured in a truly mobile mode as indicated by the rollers or wheels 18 located beneath the tank even in the presence of the granular material. In this fashion, the structure is portable, may be rolled from one location to another, such as from a patient's room to an operative suite where a patient may be transferred from an operating table directly to the fluidized support structure and returned to the patient's room. The rollers 18 and associated framework are symbolic of means to movably support the instant fluidized support structure. Accordingly, though not illustrated, the movable support means may be such that once transportation of a patient is complete, the rollers may be immobilized by conventional means to prevent inadvertent movement of the structure 10 until next desired.

While the tank or container generally indicated as 15 may be manufactured of any suitable material that will adequately support the patient and the weight of the pertinent structure, a lightweight structural material, such as reinforced fiberglass sheets, foamed core polymeric sheets, or the like may be utilized to further reduce weight of the overall structure.

Making specific reference to FIGS. 2, 3 and 4, further details of one embodiment of the patient support structure of the present invention will now be described in detail. A support member 21 is located within the confines of side walls 12 and 14 and is spaced apart from the bottom wall 16 to define a plenum chamber 22 therebetween. As indicated specifically in FIG. 4, support element 21 is preferably a skeletal framework that will not materially impede the passage of air therethrough, but will possess adequate strength to support the remaining materials thereabove. Located atop support element 21 is a diffuser plate 23 which, as illustrated in the Figures, particularly FIG. 4, has a particular contour such that the distance between the patient residing on the support structure and the diffuser plate varies according to the dictates of patient activity and weight, whereby in those areas where a greater weight per unit area is expected to occur, the contour of the diffuser element permits a greater depth of granular material thereabove. Conversely, in those areas peripheral to the support structure as well as areas where light patient contact will be experienced, a lesser depth of granular material is provided above the diffuser plate.

Figure 2:
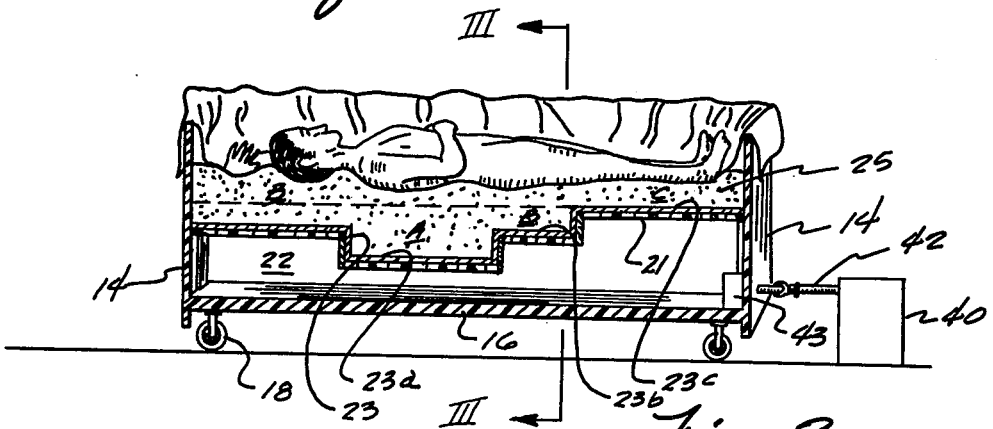
FIG. 2 is a vertical cross section view of the patient support structure as illustrated in FIG. 1, taken along a line II—II.
Figure 3:
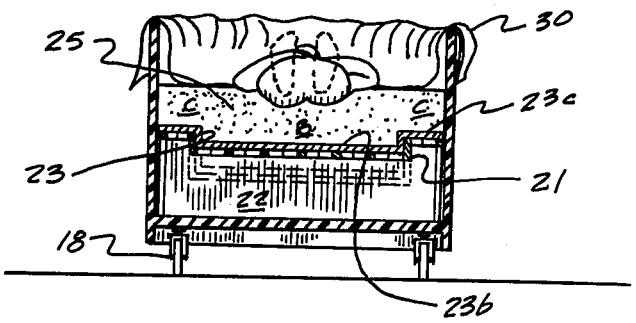
FIG. 3 is a vertical cross sectional view of the patient support structure as shown in FIG. 1, taken along a line III—III.
Figure 4:
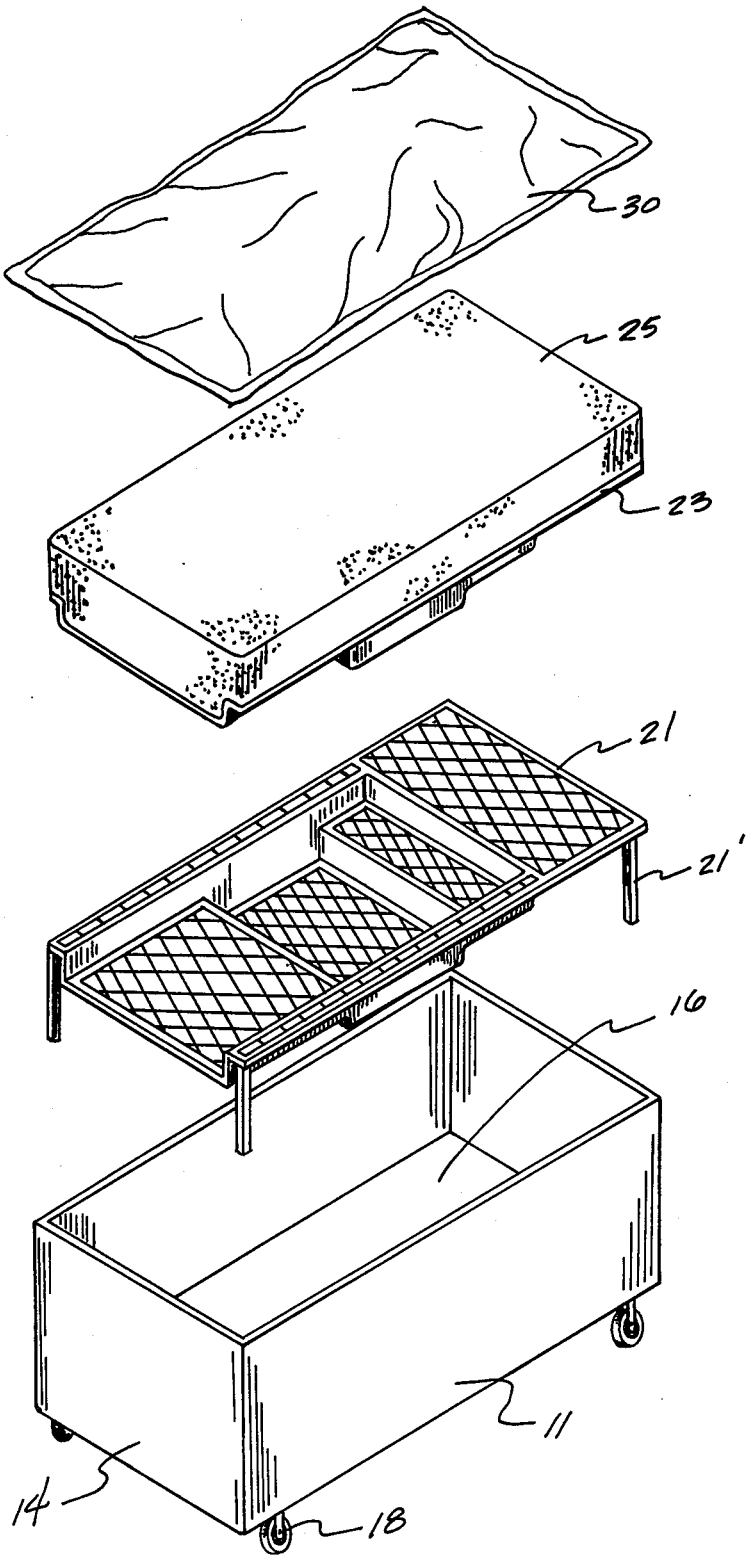
FIG. 4 is an exploded view of the elements that make up the patient support structure according to teachings of the present invention.

Making specific reference to FIGS. 2 and 3, a preferred contour of the diffuser plate is illustrated. In the area A, generally beneath the patient's buttocks and mid torso of the body and intermediate said container, a fluidized bed depth of about 11 to 12 inches is provided above the diffuser board 23 for an adult system when utilizing ceramic spheres. The greater patient pressure and weight in area A will thus not overcome the bouyant force of the fluidized bed and permit general contact between the patient's body and diffuser board 23, particularly when the patient is in a sitting position. Likewise in those areas indicated as B, these is less weight per unit area and less likelihood of patient movement that would create a "bottoming out" between the patient and the diffuser board 23, a lesser thickness of fluidized bed is present, for example about 9 inches, though adequate as mentioned above, to prevent "bottoming out". These areas are located generally along the legs and the upper torso. Still further, in the area generally beneath the patient's feet and thereabove for the remainder of the distance of the support structure, the diffuser board 23 is located at yet a different elevation, indicated by C, as well as around the periphery of the support structure to provide a fluidized bed depth of about 6 inches, for example. The varying level of the diffuser plate 23 are indicated as 23*a*, 23*b*, and 23*c*, corresponding to the support areas A, B and C. Though the recited depths for sections A, B and C are preferred for an overall adult structure, obviously the particular depth requirements are determined by the mass of the granular material, porosity of the diffuser plate and fluid pressure and flow rate acting thereon.

Buoyant force exerted by the fluidized granular materials, such as the ceramic microspheres, on the top side of the diffuser board is proportional to the depth of the granular material above same. In order, therefore, to prevent an uneven distribution of fluidizing air across the surface of the support structure, the porosity of the diffuser board 23 varies with the height of same above the bottom of container 10, and directly with the depth intended for the fluidized bed above same. A more porous structure would be provided for the diffuser section 23*a* where a fluidized bed depth A is provided, while section 23*b* coresponding to fluidized bed depth B, is less porous, and still further, section 23*c*, coresponding to fluidized bed depth C, is still lesser porous. In this fashion, the overall diffuser plate 23 therefore has a variable porosity across the surface of same, varying directly with the depth of fluidized bed intended to be provided thereabove.

Located atop diffuser plate 23 is a mass of granular material 25 which is in essence located between diffuser plate 23 and flexible sheet 30. In a non-fluidized state as illustrated in FIG. 2, the mass of granular material will simply be concentrated against the diffuser plate 23 and a patient lying thereon will mold itself within the mass of material, which in the non-fluidized state becomes rigid and permits traction to be placed on the body against the rigidity of the granular materials.

A fluid pressure generating means generally indicated as 40 is provided to communicate with plenum chamber 22 to generate a particular fluid pressure therein. As illustrated in FIG. 2, the fluid pressure generating means 40 is located without the structure 10 and communicates with plenum chamber via a conduit 42. Also as schematically illustrated, fluid conditioning means 43, as exemplified by a heater, may be provided to heat or otherwise condition the fluid. Obviously, the fluid pressure generating means 40 may likewise be located within plenum chamber 22 as well, particularly where the structure is designed for mobility, whereby it would only be necessary to provide electrical connector means to fluid pressure generating means 40 to actuate same to fluidize the granular material. In fact, fluid pressure generating means 40 could be battery operated, whereby, a totally self-contained fluidized patient support structure is provided. Insofar as fluid pressure generating means 40 is concerned, any suitable apparatus capable of generating adequate fluid pressure within plenum chamber 22 would be acceptable. With a generally constant fluid pressure within plenum chamber 22, the fluid escapes plenum chamber 22 via diffuser plate 23, and according to the degree of porosity of the particular sections of diffuser plate 23, the fluid will act on the granular material and suspend same above the diffuser plate at a particular level depending upon porosity of the plate section.

Figure 5:
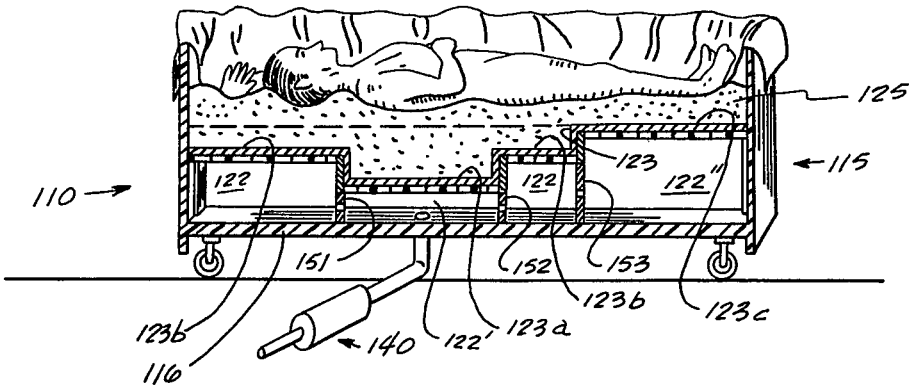
FIG. 5 is a vertical cross section of a patient support system as would be viewed along a line similar to II—II of FIG. 1, illustrating a further preferred embodiment of the present invention.
Figure 6:
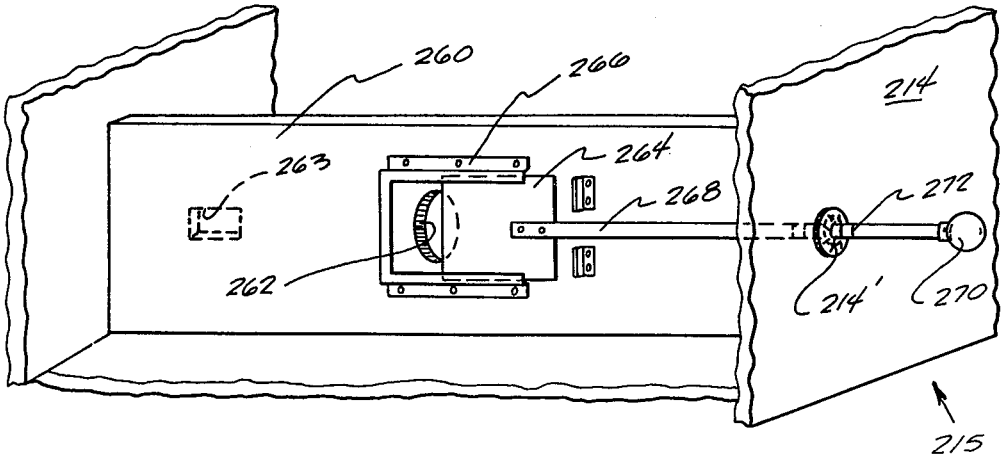
FIG. 6 is an isometric view of a baffle of the type generally employed in the embodiment illustrated in FIG. 5 and illustrating a further preferred embodiment of the present invention.

Referring to FIGS. 5 and 6, further embodiments of the present invention will be described in detail. A patient support system generally 110 is shown having a contoured granular material, porous support means generally 123 with appropriate sections 123*a*, 123*b* and 123*c* located at predetermined heights above a bottom wall 116 of open ended container generally 115 and residing upon a skeletal base 150. Support means 123 has a common porosity across all sections. A plurality of baffle wall means 151, 152 and 153 are secured between a lower side of base 150 and bottom wall 116 defining plenum chambers 122, 122' and 122'', with each wall having means associated therewith for limiting fluid flow therethrough, as, for example, is illustrated in FIG. 6. Particularly, each of baffle means 151, 152 and 153 preferably has one or more orifices, etc. of predetermined size and/or shape to permit a predetermined fluid flow only therethrough. As such, with uniform porosity of support means 123, fluid pressure for each depth section of same may be varied and controlled to fluidize the granular material thereabove adequate to support a supine patient. As illustrated, a fluid pressure generating means generally 140 is in communication with plenum chamber 122', whereby the pressurized fluid will pass through the particular orifices, etc. of baffle means 151, 152, and 153 into the other plenum chambers to properly fluidize the granular material 125 thereacross. Likewise, while not shown, obviously a plurality of fluid pressure generating means could be employed for the various baffle sections, with the baffle means for each being imperviuos to fluid flow.

As may be specifically seen in FIG. 6, a baffle means 260 is illustrated having an orifice 262 with an adjustable valve means or cover plate 264 moveable thereacross in appropriate slide tracks 266. Valve means 262 has an elongated control element 268 secured thereto and extending outwardly therefrom through a second opening 214' in side wall 214 of container 215 and terminating at a handle means 270. Movement of element toward or away from side wall 214 will open or close orifice 262, and indicia 272 are provided therealong to indicate the degree of opening of orifice 262 for particular positions of element 268 with respect to side wall 214. Orifice 262 could thus be calibrated for fluid flow therethrough, at certain degrees of closure for future fluid flow adjustment, if necessary. FIG. 6 further illustrates a further, rectangular shaped orifice 263 in phantom to indicate that any number of orifices or orifice shapes may be employed if desired.

While not specifically recited herein, it is likewise within the scope of the present invention to include intermittent or cyclic fluid pressure actuation in connection with fluid pressure generating means 40 and 140 as described in the Hargest U.S. Pat. No. 3,866,606, and the portion of said patent directed thereto is incorporated herein by reference. Generally speaking, the system would be capable of intermittently actuating fluid pressure generating means 40 and 140 at predetermined intervals to fluidize the granular material 25 and thus suspend the patient atop same. During deactuated intervals, the patient will settle within the granular material with the patient body defining a body contour therewithin. Such permits, as mentioned above, traction to be imparted to the patient against the rigidity of the granular material in the non-fluidized state and likewise permits pressure variation on the patient to lessen the incidence of development of decubitus ulcers.

While any porous material may be utilized that will accomplish the intended result while precluding the passage of the granular material therethrough, a very suitable diffuser board may be fabricated from porous polymeric materials such as the POREX porous plastics manufactured by Glasrock Products, Inc., Fairburn, Ga. The porous plastics are in essence porous polymeric material, with the porosities of same being omnidirectional interconnecting pores, the size of which can be controlled between about 10 and 500 micrometers depending upon the polymer used. Since the various sections are located at different levels, vertical plate sections may be utilized to join same, for it is desirable that the thrust of the pressurized fluid through the diffuser plate act in an unidirectional fashion to fluidize the granular materials thereabove. Particular interrelationships of fluid flow and pressure relative to granular material depth are set forth below in Tables I and II.

Tests were made employing a 9 inch by 9 inch diffuser board constructed of POREX SPIGUM material having a thickness of 0.775 inch. The diffuser board was placed within a container with a variable speed blower arranged therebeneath. Normally 100 micron diameter spherical shaped soda-lime glass beads were utilized, and were initially placed within the container to adequately cover the bottom. Bead depth was measured at 0.875 inch. Thereafter air flow was instituted and was increased until the beads became fluidized. Fluidization was determined at two levels. Incipient fluidization was detected when a wooden block resting on the beads began to float, and boiling fluidization when the block appeared to be bouncing on bead "waves" observed across the bead surface. At boiling fluidization bead depth generally increased about 20 percent. Air pressure and air flow was then measured. Air flow was then interrupted and a further quantity of beads poured across the surface of the diffuser board, and the procedures set forth above were repeated. Like results were noted for fluidization, and consistently bead depth increased about 20 percent at fluidization. Results are set forth below in Table I. Fluidizing gas was air at standard temperature and pressure.

TABLE I

| Bead Depth* (inches) | Gas Pressure (inches water gauge) | Gas Flow (Actual $ft^3$/min) |
|---|---|---|
| 0.875 | 4.8 | 2.94 |
| 1.750 | 5.3 | 2.82 |
| 2.250 | 6.2 | 2.81 |
| 3.250 | 7.5 | 2.88 |
| 4.250 | 8.8 | 3.09 |
| 5.00 | 10.2 | 3.21 |
| 5.625 | 11.1 | 3.18 |
| 6.250 | 12.4 | 3.48 |
| 7.250 | 13.2 | 3.18 |
| 8.00 | 14.4 | 3.36 |
| 8.50 | 15.3 | 3.48 |
| 9.50 | 16.2 | 3.58 |

TABLE I-continued

| Bead Depth* (inches) | Gas Pressure (inches water gauge) | Gas Flow (Actual $ft^3$/min) |
|---|---|---|
| 10.25 | 18.2 | 3.92 |

*Prior to fluidization.

A second set of data were obtained under like procedures as followed for the experiments tabulated in Table I except that the diffuser board was 0.40 inch thick and was 32 inches by 84 inches in size (approximate bed size). Due to the large size of the diffuser board, gas flow was not measured. Results are tabulated in Table II.

TABLE II

| Bead Depth* (inches) | Gas Pressure (inches water gauge) |
|---|---|
| 1 | 2.0 |
| 2 | 4.5 |
| 3 | 5.5 |
| 4 | 7.0 |
| 5 | 8.1 |
| 6 | 9.5 |
| 7 | 11.1 |
| 8 | 12.4 |
| 9 | 14.0 |
| 10 | 16.0 |

*Prior to fluidization.

Other suitable materials from which the diffuser plate may be manufactured, without limitation, include porous ceramic materials, porous metallic materials, porous cellulosic materials and hybirds.

Granular materials suitable for use in the improved patient support structure of the present invention may be any suitable granular material that will become fluidized upon rceipt of the desired fluid pressure. Such materials include, but are not limited to, sand, glass beads, ceramic spheres, and the like.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. An improved fluidizable patient support structure comprising:

(a) an open top container means;

(b) a mass of granular material received within said container;

(c) means for supporting non-fluidized granular material at predetermined varying depths within said container, said support means being porous to fluid passage and impervious to passage of granular material;

(d) means for fluidizing said granular material above said material support means, said fluidizing means and porosity of said material support means being correlated such that said granular material across said container is fluidized adequately to support all body areas of a patient in a supine position; and (e) flexible means enclosing said granular material for receipt of a patient thereon, said flexible means permitting passage of fluid through at least a portion of same while precluding passage of granular material therethrough.

2. A fluidizable patient support structure as defined in claim 1 wherein said support means is defined by a plurality of separate sheets, at least certain of said sheets exhibiting a different fluid porosity than other of said sheets.

3. A fluidizable support structure as defined in claim 1 wherein said support means is arranged to receive a greater depth of granular material intermediate the length of same in the general area where a patient's buttocks may reside, the depth of granular material thereat being sufficient that the weight of a patient sitting on said structure will not completely defluidize said granular material.

4. A fluidized patient support structure as defined in claim 1 wherein said granular material is glass spheres.

5. A fluidized patient support structure as defined in claim 1 wherein said support means is located within said container, spaced above a bottom of said container, and cooperates with walls of said container below same to define a fluid plenum chamber therebetween.

6. A fluidizable patient support structure as defined in claim 5 further comprising baffle means located beneath said support means, said baffle means cooperating with walls of said container to define a plurality of plenum chambers, each plenum chamber corresponding to a particular segment of said support means, each said baffle means further being adapted to permit predetermined fluid flow only therethrough, whereby fluid parameters in each plenum chamber any be controlled to properly fluidize the granular material thereabove.

7. A fluidizable patient support structure as defined in claim 6 wherein said means for fluidizing said granular material comprises a fluid blower means in communication with an interior of one of said plenum chambers, and said baffle means define at least one orifice of a predetermined size and configuration to permit passage of fluid therethrough adequate for fluidization of granular material above the plenum chamber therebehind.

8. A fluidizable patient support structure as defined in claim 5 wherein said means for fluidizing said granular material comprises a fluid blower means in communication with an interior of said plenum chamber.

9. A fluidizable patient support structure as defined in claim 7 wherein means are associated with said fluid blower means to condition a fluid supplied to said plenum chamber thereby.

10. A fluidizable patient support structure as defined in claim 1 wherein said means for enclosing said open top of said container comprises a flexible sheet of material that is received on said container such that said material remains loose beneath a patient received thereon.

11. A fluidizable patient support structure as defined in claim 10 wherein said sheet is fluid permeable while being impermeable to passage of granular material.

12. A fluidizable patient support structure as defined in claim 1 wherein the porosity of said support means varies directly with the depth of granular material to be fluidized thereover.

13. A fluidizable patient support structure as defined in claim 12 wherein a greater depth fluidizable granular material is located intermediate the structure with at least one lesser depth of fluidizable granular material located adjacent thereto.

14. An improved fluidizable patient support structure comprising:

(a) an open top container defined by a bottom wall and side walls;

(b) a frame received in said container, spaced above said bottom wall;

(c) a support means received on said frame, said support means being porous to the passage of a fluid therethrough and impervious to the passage of granular material to be received thereover, said support means having a predetermined contour;

(d) a mass of granular material received within said container atop said support means, the depth of granular material above said support means varying with the contour of said support means;

(e) flexible cover means for said container; and (f) means to fluidize said granular material above said support means, said fluidizing means and porosity of said support means being correlated to fluidize said granular material above said porous support means adequately to support a patient in a supine position thereon and the depth of granular material and porosity of the support means at areas where a patient would normally sit on the structure being such that the patient will also be supported in a sitting position without sinking through the granular material into contact with said support means.

15. A fluidizable patient support structure as defined in claim 14 comprising further, baffle means located below said support means, said baffle means cooperating with walls of said container to define a plurality of plenum chambers coincident with the contour of said support means, said baffle means further being adapted to permit predetermined fluid flow only therethrough, whereby varied, controlled fluid flow and pressure may be produced in each plenum chamber to properly fluidize the granular material thereabove.

16. A fluidizable patient support structure as defined in claim 15 wherein at least certain of said baffle means define an orifice therein.

17. A fluidizable patient support structure as defined in claim 16 wherein said orifice has adjustment means associated therewith.

18. A fluidizable patient support structure as defined in claim 17 wherein said adjustment means are operable from outside said container.

* * * * *